US006857531B2

(12) United States Patent
Slat et al.

(10) Patent No.: US 6,857,531 B2
(45) Date of Patent: Feb. 22, 2005

(54) PLASTIC CONTAINER

(75) Inventors: William A. Slat, Brooklyn, MI (US); Richard C. Darr, Medina, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/630,404

(22) Filed: Jul. 30, 2003

(65) Prior Publication Data

US 2004/0144748 A1 Jul. 29, 2004

Related U.S. Application Data

(63) Continuation-in-part of application No. 10/354,590, filed on Jan. 30, 2003, and a continuation-in-part of application No. 29/186,044, filed on Jul. 8, 2003.

(51) Int. Cl.[7] ..... B65D 1/46

(52) U.S. Cl. ..... 215/382; 215/373; 215/375; 215/381; 215/383; 220/609; 220/669; 220/672

(58) Field of Search ..... 215/12.1, 373, 215/382, 383, 379, 381; 220/609, 669, 672

(56) References Cited

U.S. PATENT DOCUMENTS 5,054,632 A * 10/1991 Alberghini et al. ..... 215/381
5,060,453 A * 10/1991 Alberghini et al. ..... 53/440
5,067,622 A * 11/1991 Garver et al. ..... 215/381
6,497,333 B1 * 12/2002 Ellis et al. ..... 215/383
2001/0027978 A1 * 10/2001 Finlay et al.
2002/0153343 A1 * 10/2002 Tobias et al.
2002/0172763 A1 * 11/2002 Plester et al.

FOREIGN PATENT DOCUMENTS

GB 2161133 A * 1/1986 ..... B65D/1/44

* cited by examiner

*Primary Examiner*—Sue A. Weaver
(74) *Attorney, Agent, or Firm*—Robert H. Bachman

(57) ABSTRACT

A plastic container with a self-supporting base, a body portion extending above the base and a neck portion above the body portion. The neck portion includes a dispensing opening. The body portion includes a substantially rigid sidewall portion with structural reinforcement thereon.

18 Claims, 10 Drawing Sheets

PLASTIC CONTAINER

CROSS REFERENCE TO RELATED APPLICATIONS

This application is a continuation-in-part of copending U.S. patent application Ser. No. 10/354,590 for HOT FILLABLE CONTAINER WITH FLEXIBLE BASE PORTION, filed Jan. 30, 2003, and copending U.S. patent application Ser. No. 29/186,044 for BOTTLE, filed Jul. 8, 2003.

BACKGROUND OF THE INVENTION

The present invention relates to plastic containers including a substantially rigid wall portion, particularly plastic containers that use vacuum, as in an internal coating operation or that are hot fillable to facilitate resistance to deformation and improve the aesthetic display of a label.

Hot-fill containers are known in the art. When liquid contents that fill a container at elevated temperatures are permitted to cool, a strong internal pressure or vacuum is generated. Conventional hot-fill containers generally accommodate the vacuum pressure, which can be significant, by employing a rigid base portion (which may further include strengthening ribs or other formations) and flex panels that are configured in the sidewall portion of the container to accommodate the change in internal pressure.

A problem that sometimes occurs in connection with the use of flex panels in the sidewall of the container concerns labeling. Indentations, voids or spaces can sometimes be intentionally or unintentionally formed at or about the label mounting portion of the container. Such structural features can cause the label to wrinkle, tear, or otherwise distort and, among other things, can inhibit or prevent the prominent display of an aesthetically pleasing label. Moreover, some consumers may desire a container that is filled with product wherein a label is wrapped tightly around the container and is adhered to what feels like a solid and more rigid container sidewall.

Further, conventional hot fillable containers are commonly produced at a first location by a manufacturer and are then shipped or transported to a second location (often at the customer's facility) where they are filled with product contents and then labeled. In the case of hot-filled product containers, as the product contents cool, a vacuum pressure is created. Typically, the vacuum is accommodated at the second ("filling") location by formations in the portions of the side wall of the container that are permitted to collapse or flex inwardly. In many instances employing conventional sidewall configurations, the internal vacuum can cause significant labeling problems, including those previously mentioned.

In addition, a coating procedure to coat the internal surface of a plastic container may use a vacuum in the container, as for example, a carbon coating. This may cause similar problems as those outlined above. Also, if one tries to light weight the container, the container would be prone to collapse.

It is, therefore, an object of the present invention to provide an improved plastic container with a strengthened body or sidewall structure.

It is a further object of the present invention to provide an improved container as aforesaid with a body or sidewall structure that resists deformation when a vacuum is formed within the container.

Further objects and advantages of the present invention will appear hereinbelow.

SUMMARY OF THE INVENTION

In accordance with the present invention the foregoing objects and advantages are obtained.

The present invention in one embodiment comprises a plastic container comprised of a closed base, a body portion, and a neck portion. The closed base includes a substantially rigid support portion and a flexible portion, and may further include a transition segment located between the support portion and the flexible portion. The body portion includes a substantially rigid wall portion that includes a plurality of reinforcement formations and, if desired, the body portion may further include a shoulder portion. The neck portion includes a dispensing opening that can be used to fill or dispense product contents. The container is configured so that the flexible portion of the base contracts or moves upwardly about the support portion in response to vacuum pressures generated within the container, while the substantially rigid portion of the sidewall remains substantially rigid, for example, to accept or receive a label. Further, to accommodate additional vacuum effect, other portions of the container, such as the shoulder portion, may also include vacuum or pressure relief formations.

The present invention also comprises a method for producing hot-fillable, labeled containers, including the production of hot-fillable, labeled containers at a first (e.g., "manufacturer's") site before being shipped to a second (e.g., "customer's") location for filling, is also disclosed.

In addition, the present invention covers a plastic container, comprising: a self-supporting base; a body portion extending above the base; and a neck portion extending above the body portion, said neck portion including a dispensing opening, wherein said body portion includes a substantially rigid sidewall portion including a structural reinforcement including a plurality of reinforcement formations in the form of indentations and interspersed lands extending around the body portion and arranged in a staggered configuration.

Further features of the present invention will be discussed hereinbelow.

DESCRIPTION OF PREFERRED EMBODIMENTS

Figure 1:
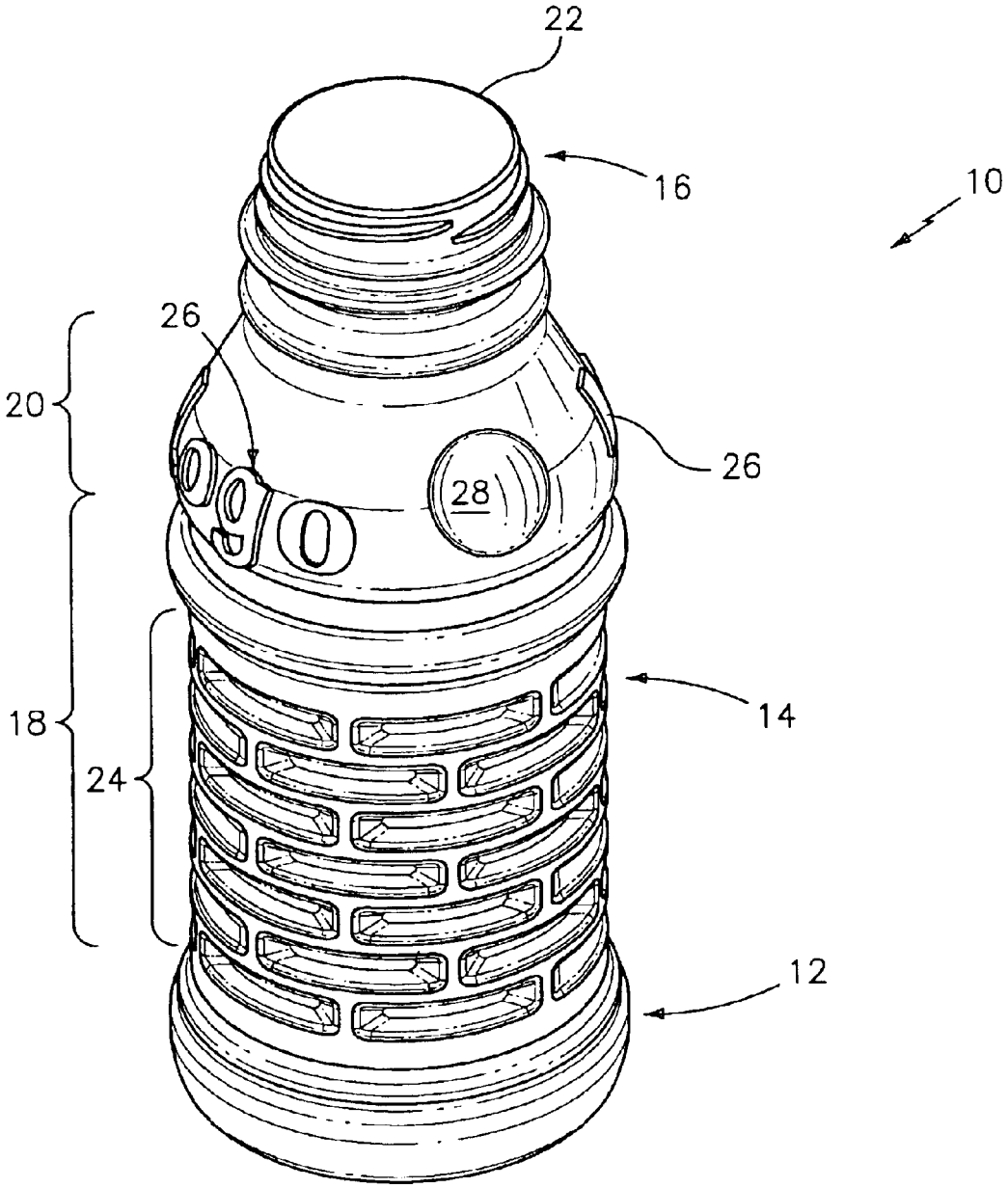
FIG. 1 is a perspective view of a container embodying teachings of the present invention.

Referring to FIG. 1, an illustrative embodiment of a container 10 constructed in accordance with the teachings of the present invention is shown. The container 10 includes a closed base 12, a body portion 14 extending above base 12, and neck portion 16 extending above body portion 14. The body portion 14 preferably includes a wall portion 18 and a shoulder portion 20. The neck portion 16 includes a dispensing opening 22, which preferably includes a closure means (such as threads) and can be used for filling and/or dispensing product contents.

The wall portion 18 provides at least partial support for the body portion 14 and includes a substantially rigid portion 24. Preferably, rigid portion 24 is configured to provide increased resistance to internal pressures (e.g., an internal pressure or vacuum) and substantially maintains its original shape under pressure. Further, as desired, the rigid portion 24 may be configured to receive and support a label, such as for example, a spot label or wrap-around label.

The body portion 14 may include an image, symbol, or other visual features of formations, such as a logo 26, and/or one or more pressure relief formations 28. As discussed further hereinafter, such features, if included, may provide a partial relief for vacuum forces that are internally generated with the container. Moreover, if such features are included, they preferably are, but are not required to be, included in a shoulder portion 20.

Typically, a vacuum or other internal pressure will cause the container to at least initially collapse at portions of the container that are not reinforced or are otherwise comparatively less rigid. As such, it is desirable that the rigid portion 24 is sufficiently stiff or firm so that the substantial majority of an internal vacuum pressure (such as caused by the cooling of a hot filled liquid content) is first accommodated or absorbed by a less rigid, more flexible portion of the base 12.

In a preferred embodiment, the rigid portion 24 includes one or more structural reinforcements that, among other things, can serve to strengthen and/or improve the firmness or rigidity of the associated or corresponding wall portion 18. Moreover, in portions of the container associated with support of a label and/or gripping, the rigid portion 24 is preferably at least as rigid, if not more rigid, than other portions of the body portion 14. The structural reinforcement features may include, but are not limited to, strengthening ribs, posts, panel structures and/or various formations, including features and configurations known in the art for improving wall strength or resistance to deformation.

Figure 2:
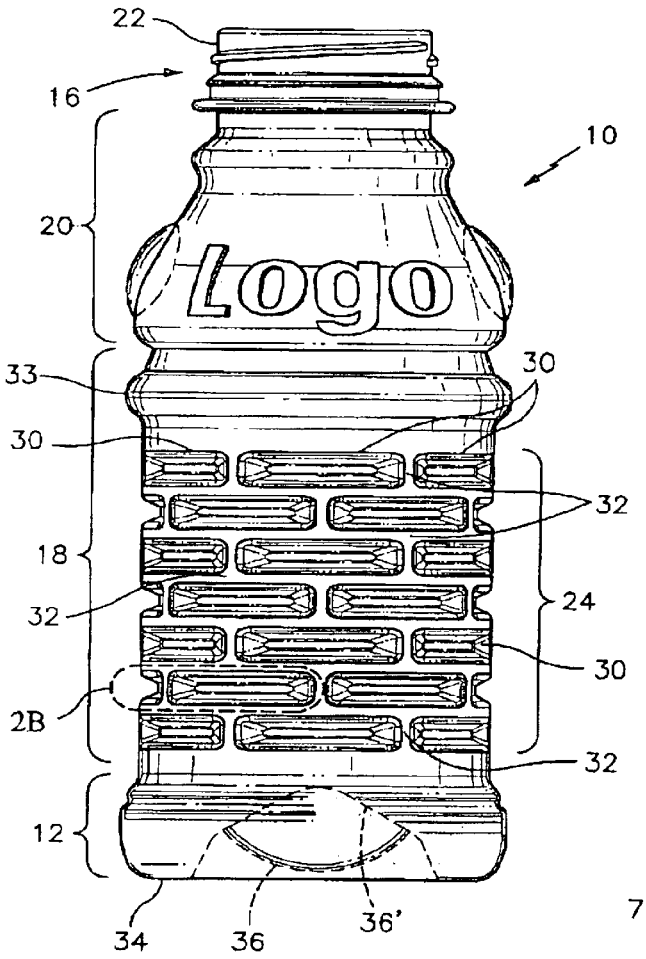
FIG. 2 is a front elevation view of the container illustrated in FIG. 1 wherein portions of the base are shown in different positions in phantom lines.
Figure 3:
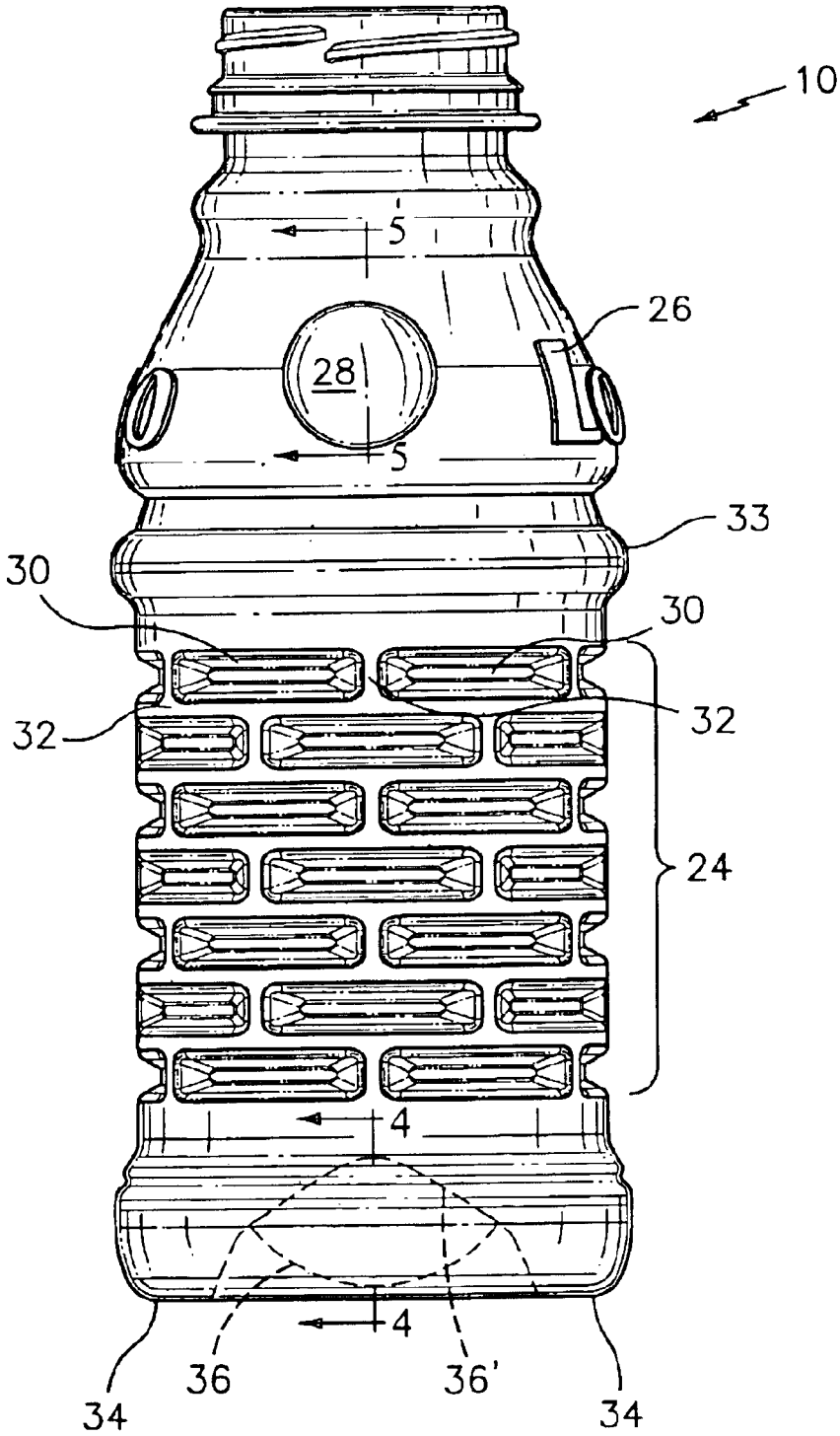
FIG. 3 is a side elevation view of the container illustrated in FIG. 1, wherein portions of the base are shown in different positions in phantom lines.

FIGS. 2–3 illustrate a sample wall portion 18 that includes a structural reinforcement. The depicted reinforcement comprises a plurality of reinforcement formations 30 and interspersed lands 32. If desired or required, the wall portion 18 may also include additional structural formations, which may also provide some measure of structural support for the body portion 14, such one of more annular rings 33. The illustrated reinforcement formations 30 are depicted as rectangular-shaped indentations that are arranged in a spaced or staggered, "brick"-like configuration. In the container 10 shown, a label (such as a wrap-around label, not shown) would primarily contact and be held firmly to the lands 32. However, the present invention is not limited to the illustrated embodiment, and the associated structural reinforcement may take on a variety of structural features, configurations or patterns, (including that in which some formations extend outwardly from the body portion) provided that the reinforcement provides sufficient improved or increased support and reinforcement against deformation from internal pressure, particularly with respect to other portions of the container that are intended to initially or more completely absorb or accommodate a volumetric reduction including, without limitation, the flexible portion of the base and/or other pressure relief formations.

Figure 4A:
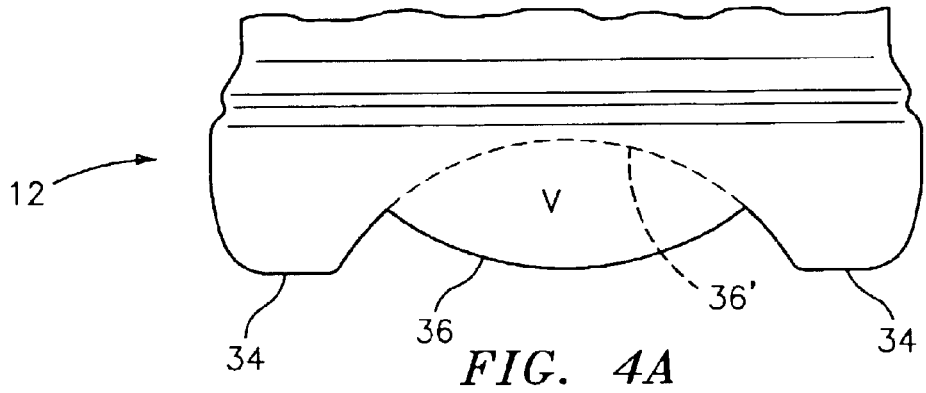
FIG. 4A is a cross-sectional view of a base portion of a container shown as would be generally taken along line 4—4 of FIG. 3, wherein a flexible portion of the base is shown in a first position in solid line form and a second position in phantom line form.
Figure 4B:
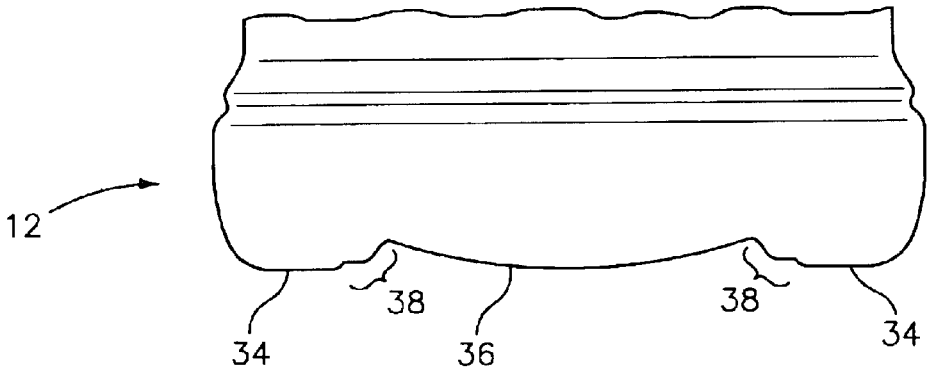
FIG. 4B is a cross-sectional view of another embodiment of a base portion, shown in a similar orientation as the base portion shown in FIG. 4A, wherein the flexible portion of the base is shown in a more shallow and less concave first position in solid line form.
Figure 4C:
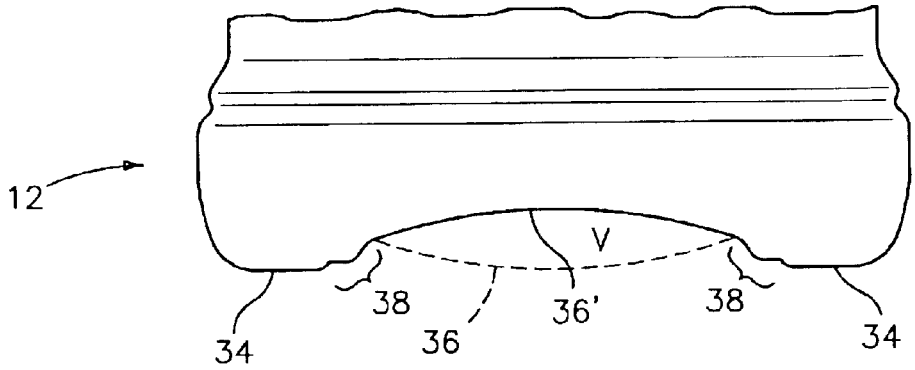
FIG. 4C is a cross-sectional view of the base portion shown in FIG. 4B, wherein the flexible portion of the base is shown in a first position in phantom line form and a second position in solid line form.

The closed base 12 is configured to support the container 10 on a surface. In preferred configurations, the base 12 is comprised of at least two components, a rigid component and a flexible component. As illustrated in FIGS. 4A through 4C, base 12 includes a substantially rigid support portion 34 and a flexible portion 36, and (for example as shown in FIGS. 4B and 4C) may include transition segment 38 positioned between the support portion 34 and the flexible portion 36. The transition between the support portion 34 and the flexible portion 36 should be such that the flexing of the flexible portion 36 does not cause unacceptable level of stress in the base 12. In a preferred embodiment, the portions of the base, particularly the transitions at or about the outer periphery of the flexible portion 36 will be substantially gradual and free of sharp transitions. Among other things, that can involve or include gradual radiuses so that no pinch-points are created where flexing is intended to occur.

FIG. 4A depicts a cross-sectional representation of a base 12 of a container including features and embodiments associated with the present invention. Flexible portion 36 is shown in a first position in solid line form and a second position (designated as 36') in phantom line form. The first position shows a form of the base 12 that generally corresponds with a pre-filling condition, i.e., before contents have been added. In such a condition, the flexible portion 36 extends away from the container, such as in the outwardly "convex" configuration shown.

The second position, shown in phantom line as 36', generally represents the position of the flexible portion 36 after an internal vacuum force has been created (such as by the cooling of a filled content) and substantially accommodated by the base 12. The volumetric area, designated as V, represents an amount of internal volume that is intended to be accommodated or absorbed by the base 12 in response to the internal vacuum or pressure. In a preferred embodiment, the accommodated volume is substantially equivalent to the volume difference between the flexible portion as shown in positions 36 and 36'.

Base 12 is preferably designed and configured to accommodate an anticipated vacuum volume and, to the extent desired, to eliminate or reduce the amount of internal pressure falling upon the body portion 14 of the container, particularly the portion associated with a label. For example, without limitation, certain containers will experience a normal shrinkage of from about 0–5% volume (and more commonly from about 2–3% volume) upon cooling of a hot-filled liquid. The design of the base 12, including the size and shape of the flexible portion 36, can be configured to accommodate the volumetric shrinkage by adjusting the associated volumetric area V.

The structural design or shape of the flexible portion 36 of the base 12 is preferably substantially rounded or hemispherical in cross-section, although other geometries, such as oval, square or rectangle, may also be employed. In a preferred embodiment, the final, i.e., post-internal-pressure, form of the base 12 is a champagne-style, such as shown in FIGS. 4A and 4C. To help avoid problems, including container instability (such as "rocking"), the lowermost point of the flexible portion 36 will preferably initially be and remain at or above the surface upon which the container 10 rests and is not visible when the container is in a standing position. However, the specific design of the base 12 and flexible portion 36, including the shape and dimensions, can be established by empirical design calculations, by physical testing, or both.

FIGS. 4B and 4C are cross-sectional representations of a base 12 of a container including features and embodiments associated with the present invention. In FIG. 4B, the flexible portion 36 is shown in a first, pre-internal-vacuum, position in solid line form. In the representative embodiment the flexible portion is depicted in a form that generally extends downwardly from the contents in a "convex" manner with respect to the support surface of the container. The associated transition segment 38 preferably is relatively smooth or radiused to help prevent or avoid sharp edges and/or the creation of unacceptable stress points. In FIG. 4C, the pre-internal vacuum pressure position is illustrated in phantom line form and the second, i.e., post-internal-pressure, "concave" position is illustrated in solid line form. The flexible portion 36 of the base performs a similar function to the flexible portion 36 shown in FIG. 4A, however, the amount of volume V to be accommodated in the base 12 is comparatively less than the volume depicted in connection with FIG. 4C.

In addition to the flexible portion 36, the body portion 14 of the container 10 may optionally include one or more additional pressure relief formations for accommodating, or being available to accommodate, additional or excess internal vacuum pressure. Although such relief formations may be used with any size of container, generally, such additional pressure relief formations are less important or necessary for use in smaller sized container packages (e.g., 12 oz., 20 oz., 24 oz.) and are more desirable or beneficial with containers holding a larger content volume (e.g., 32 oz., 64 oz., 1 gal., etc.).

Such additional pressure relief formations may, for example, function as "back-up" or "correction" features to accommodate internal vacuum pressures that, whether intentionally or unintentionally, exceed the amount or rate of vacuum that can be accommodated by the flexible portion 36 of the base 12. Typically, less rigid structural portions of a container will tend to deform first in response to internal vacuum pressures. Therefore, at least with respect to the more rigid body portions of the container (such as the rigid portion 24), the relief formations can be configured to generally accommodate all or substantially all of the vacuum 'pressure before such pressure would typically act to deform other body portions of the container where deformation is less desirable, such as the rigid portion 24.

The pressure relief formations may take the form of a wide variety of structural shapes and forms including, without limitation, round, oval, square, triangular or rectangular formations that can move inwardly with response to an internal pressure. The pressure relief formations may also take the form of a logo, logo panel, or a wide variety of other formations or features that can collapse in response to an internal pressure that is not otherwise accommodated by other portions of the container 10, including the flexible portion 36 of the base 12.

Figure 5B:
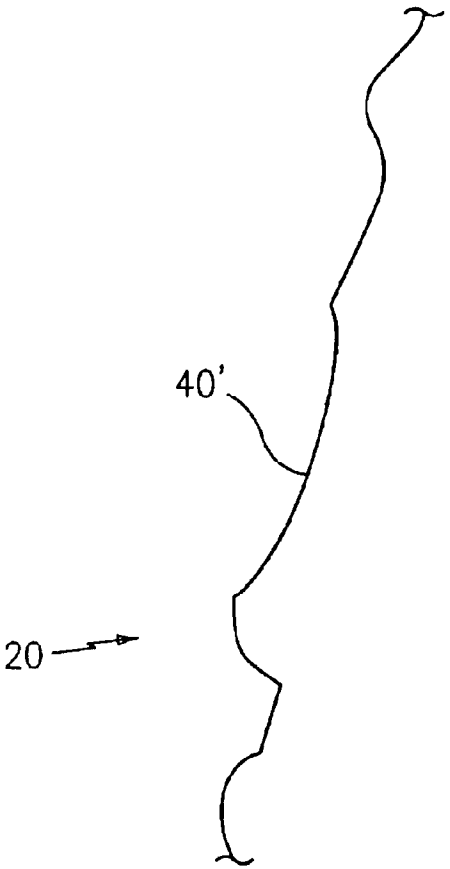
FIG. 5B is a cross-sectional view of the shoulder portion of the container taken along line 5—5 of FIG. 3, showing the pressure relief formation in a configuration after having accommodated an internal vacuum pressure.
Figure 5A:
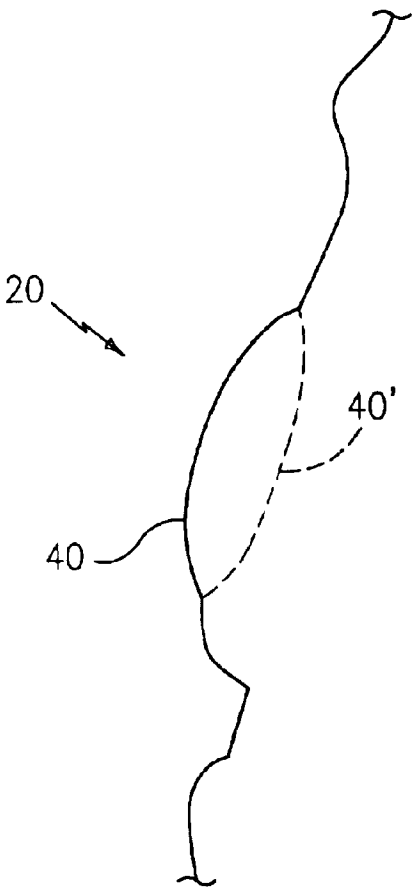
FIG. 5A is a cross-sectional view of the shoulder portion of the container taken along line 5—5 of FIG. 3, showing a pressure relief formation in a first position (shown in solid line form) and a second position (shown in phantom line form).

FIGS. 5A and 5B depict cross-sectional views of the shoulder portion of a container, which includes a sample pressure relief formation 40. FIG. 5A illustrates the representative pressure relief formation 40 in a first position (shown as a solid line) and in a second position (shown in phantom line and generally designated as 40'). FIG. 5B shows the pressure relief formation 40' in a configuration after having substantially accommodated an internal vacuum pressure.

Further, although not required, the container—particularly those that encounter pressurization—may be subjected to other processes to impart additional properties. For example, without limitation, the container may additionally be heat set to impart further resistance to deformation. However, heat setting is not required and, in a number of instances, such as the case with non-pressurized containers, no heat setting may be desired or necessary.

Preferably, the container 10 is comprised of plastic material. However, it should be noted that the invention is not limited to a specific material or combination of materials and, without limitation, may be comprised of a wide variety of plastic materials, including polyethylene terephthalate (PET), polyethylene (PE), polypropylene (PP), or a number of other thermoplastic materials in virgin, recycled, or blended forms or other combinations. Further, the container 10 is not limited to a specific formation or configuration and may be formed, for example, in various monolayer or multilayer configurations. Moreover, if desired, the container may optionally include layers, or portions of layers, that serve particular functions. Such functional layers may include, without limitation, a barrier layer, a scavenger layer, or other known functional materials or layers. In addition, the container may include a coating such as carbon on the internal surface of the container.

The present invention also includes an improved process or method for manufacturing and filling containers. Generally, a container will have a given product content volume, e.g., 12 oz., 20 oz., 24 oz., 64 oz., etc. As previously noted, when a container is filled with contents at an elevated temperature and the contents are allowed to cool, there is some internal volume shrinkage associated with the contents and a corresponding internal vacuum pressure is created. Through calculations and/or testing, the amount of anticipated volume reduction can be estimated or determined. Consequently, the bottle manufacturer can design and configure the container to include a flexible base portion that initially extends outwardly from the contents and, after experiencing all or a portion of an anticipated vacuum pressure, is moved toward the contents to at least partially accommodate the associated internal vacuum pressure and volume reduction. Depending upon the circumstances, the internal pressure accommodation may be partial or fairly subtle and/or may take the form of a more noticeable or defined all-or-nothing-type "pop," which could occur as the flexible portion abruptly moves from a pre-vacuum position to a post-vacuum position.

If desired, additional stress relief portions can be included in the body portion to offer additional capacity and/or corrections for anticipated volumes, including differences that have an inherent measure of variation associated with the contents and process. Further, the strength of the rigid portion of the container and the volume accommodation associated with the base and, if present, any pressure relief formations may be modified (in the form of an iterative process) until the label or labels adhered to the body portion of the container, including the rigid portion, have a desired look and feel and aesthetic quality after the vacuum and other internal pressures have been accommodated. Consequently, a container having a tightly wrapped and aesthetically pleasing label can be more easily produced.

In accordance with an embodiment of the invention, a hot fillable container that includes a strengthened body portion for receiving a label and a flexible portion in the base is molded by a manufacturer at a first location. At the first location a flexible base portion is positioned in a first, at least partially downwardly (i.e., toward the support surface) extending position. The container may also include one or more stress relief formations, which are in a pre-vacuum-pressure position. The strengthened body portion of the container is labeled at the first location prior to filling. Further, if desired, in-mold labeling systems may be employed and the label may be applied to the container during the molding/production process.

Once the manufactured container is labeled, it is moved or shipped some time thereafter to a second location (which is commonly a customer's facility, but may be at a different location in the same facility) for filling with product content. When the container is filled with product content at an elevated temperature, or an internal vacuum pressure is otherwise created, the internal pressure is accommodated by the container by the flexible portion of the base (and, if present, possibly one or more pressure relief formations in the side wall of the container that are intended to flex inwardly). The process permits the container to be filled with content at a second location, without requiring it to be labeled during or after filling and without the associated internal pressure causing significant deformation of the rigid portion of the body or the associated label affixed thereto.

Figure 6A:
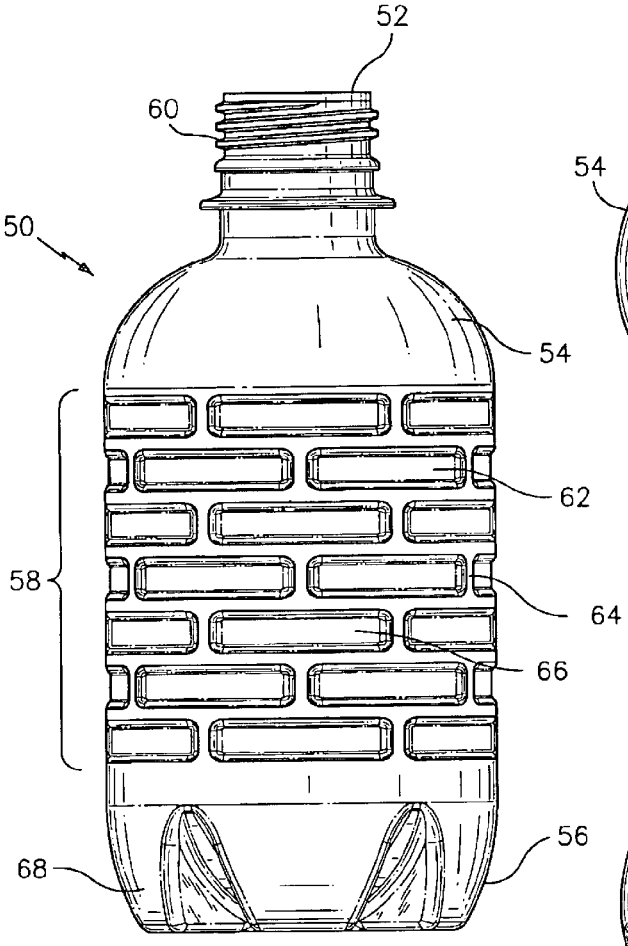
FIG. 6A is a side elevation view of an embodiment of a container of the present invention.
Figure 6B:
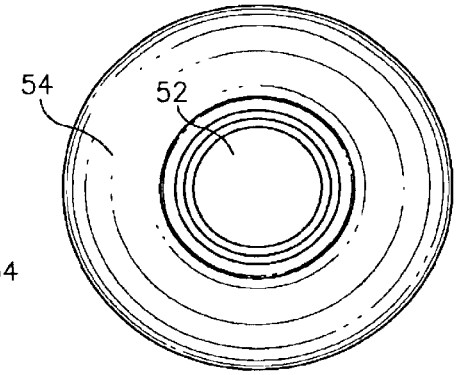
FIG. 6B is a top view of the container of FIG. 6A.
Figure 6C:
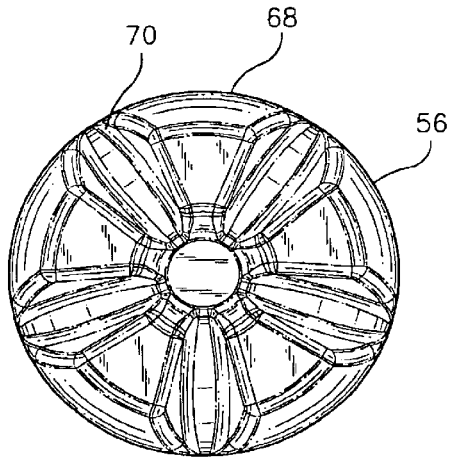
FIG. 6C is a bottom view of the container of FIG. 6A.

FIGS. 6A, 6B and 6C show an embodiment of the present invention, with FIG. 6A showing a side elevation view of container 50, FIG. 6B showing a top view of the container of FIG. 6A including dispensing opening 52 and shoulder portion 54 and FIG. 6C showing a bottom view of the container of FIG. 6A. Container 50 includes self-supporting base 56, body portion 58 extending above the base, shoulder portion 54 above the body portion, and neck portion 60 above the shoulder and body portions, with the neck portion including and terminating in dispensing opening 52. The body portion 58 includes a substantially rigid sidewall portion formed by a plurality of reinforcement formations 62 in the form of indentations separated by interspersed lands 64 such as generally shown in FIGS. 1–3. The reinforcement formations may be rectangular, brick-like formations with a recessed central portion 66. The reinforcement formations are present in a plurality of circumferential rows which extend around the periphery of the container, with seven rows shown in the embodiment of FIG. 6A, desirably with from 4 to 8 rows being used. The rectangular, brick-like formations have a width and a depth with the ratio of width to depth being from 10:1 to 2:1. For a hot-fill application the ratio of width to depth is preferably from 2:1 to 3:1, and for an internal coating operation the ratio of width to depth is preferably from 8:1 to 10:1. As shown in FIGS. 6A and 6C, base 56 includes a plurality of support legs 68 separated by recessed portions 70.

The brick-like formations 62 desirably are in a staggered, overlapping pattern supported on either side by raised lands 64.

For a hot-fill application the flexible base shown in FIGS. 2–3, for example, is desirable, as discussed hereinabove. However, in other instances the rigid wall portion of the present invention is desirable without the flexible base, as for example where one coats the internal surface of the container as with a carbon coating. Also, the depth of the brick-like formations will vary depending on the situation. A deeper brick-like indentation will give a more rigid sidewall structure. However, in some cases a less rigid sidewall is desired, as for a carbonated beverage where one would desire a shallower brick-like formation sufficient to prevent pop-out of the recess but deep enough to rigidify the sidewall for vacuum.

Figure 7A:
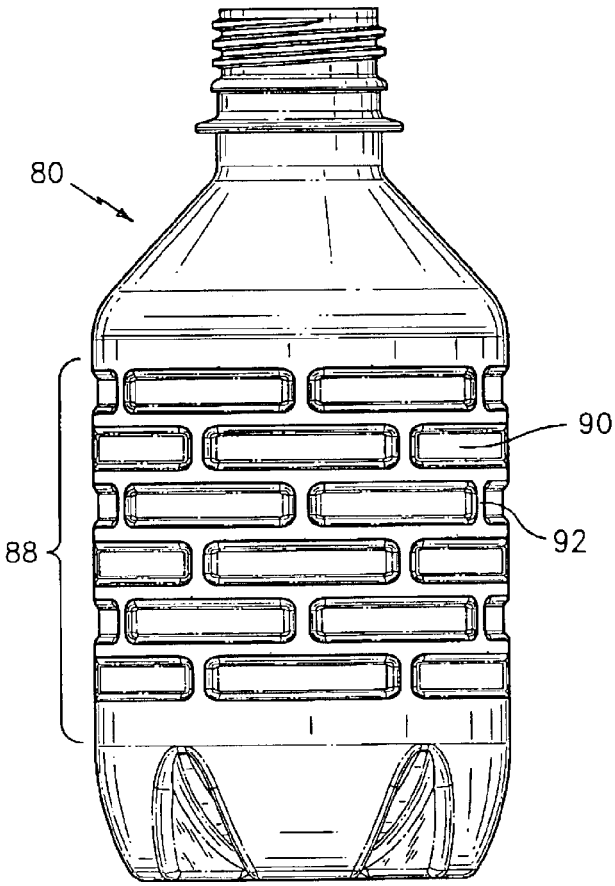
FIGS. 7A, 7B and 7C, respectively, are views similar to FIGS. 6A, 6B and 6C, respectively, showing an alternate embodiment of a container of the present invention.
Figure 7B:
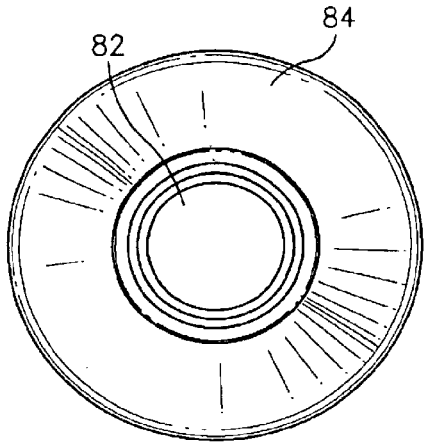
Figure 7C:
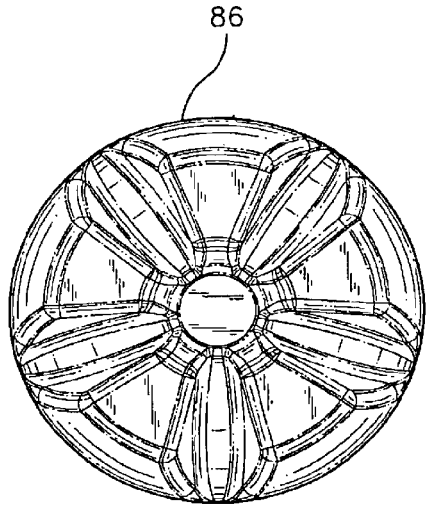

FIGS. 7A–7C show container 80 similar to container 50 and including dispensing opening 82, shoulder portion 84 and base 86. Base 86 of FIG. 7C is similar to base 56 of FIG. 6C, but sidewall 88 includes six circumferential rows of brick-like indentations 90 separated by interspersed lands 92 rather than the seven rows of indentations in FIG. 6A.

Figure 8A:
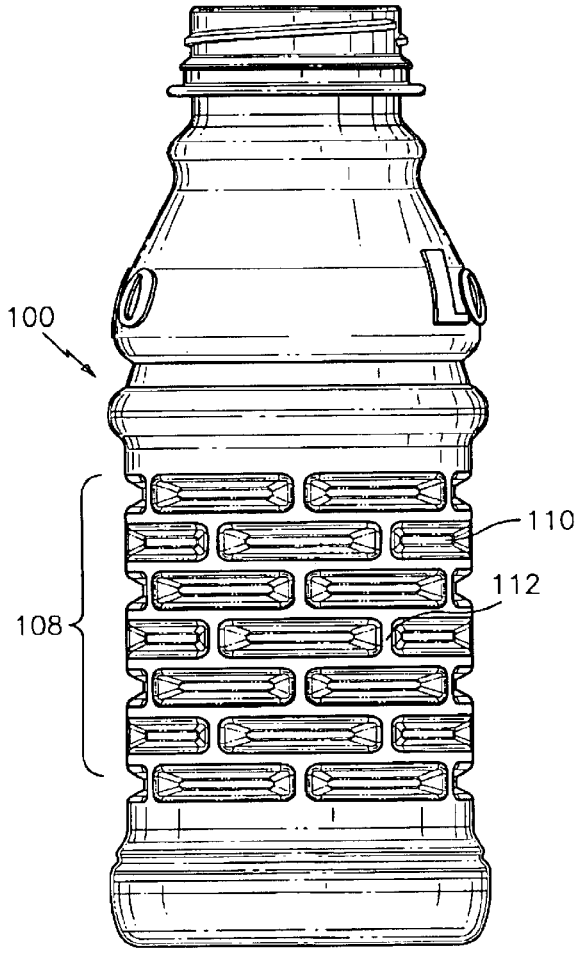
FIGS. 8A, 8B and 8C, respectively, are views similar to FIGS. 6A, 6B and 6C, respectively, showing an alternate embodiment of a container of the present invention.
Figure 8B:
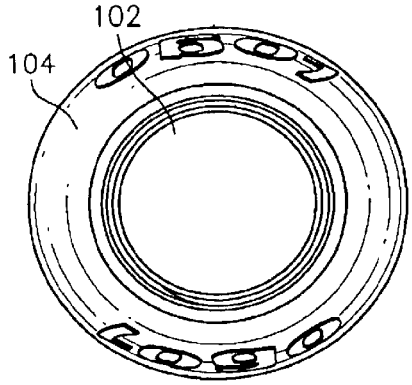
Figure 8C:
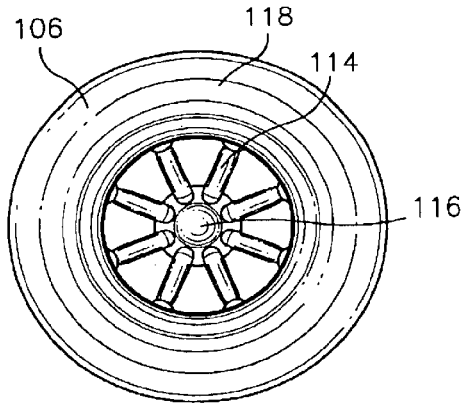

FIGS. 8A–8C show a further embodiment with container 100 including dispensing opening 102, shoulder portion 104 and base 106. Sidewall 108 includes seven circumferential rows of brick-like indentations 110 separated by interspersed lands 112, but base 106 includes a ribbed portion with ribs 114 extending outwardly from a button-like central portion 116, and a peripheral rigid support portion 118.

Figure 9A:
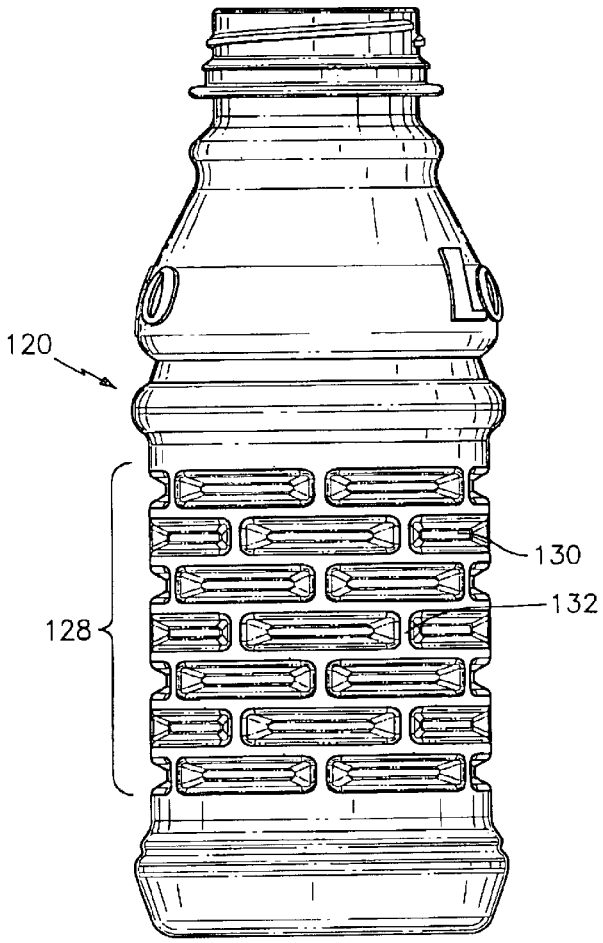
FIGS. 9A, 9B and 9C, respectively, are views similar to FIGS. 6A, 6B and 6C, respectively, showing an alternate embodiment of a container of the present invention.
Figure 9B:
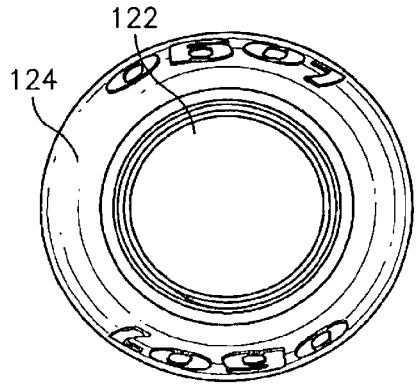
Figure 9C:
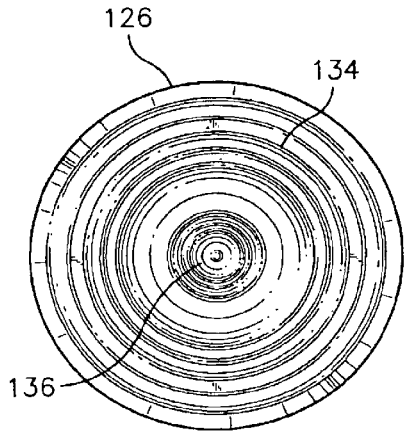

FIGS. 9A–9C show a still further embodiment with container 120 including dispensing opening 122, shoulder portion 124 and base 126. Sidewall 128 includes seven circumferential rows of brick-like indentations 130 separated by interspersed lands 132, but base 126 includes a circumferential ribbed area 134 surrounding a central button-like portion 136.

Figure 10A:
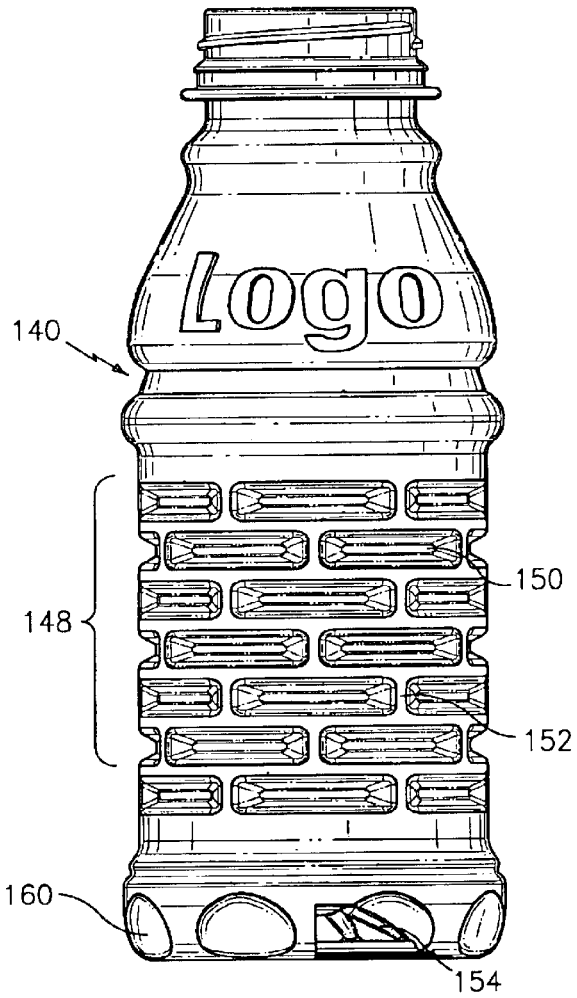
FIGS. 10A, 10B and 10C, respectively, are views similar to FIGS. 6A, 6B and 6C, respectively, showing an alternate embodiment of a container of the present invention.
Figure 10B:
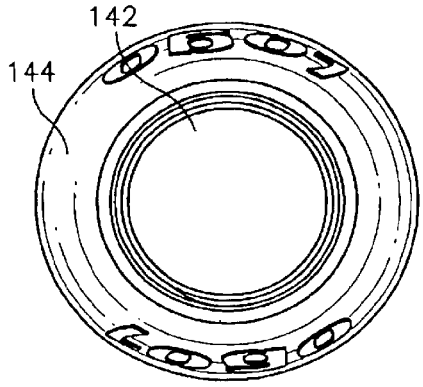
Figure 10C:
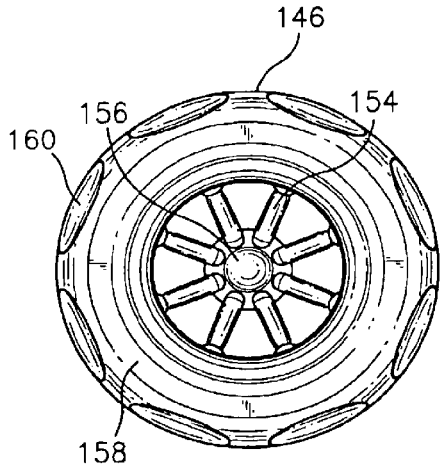

FIGS. 10A–10C show a further embodiment with container 140 including dispensing opening 142, shoulder portion 144 and base 146. Sidewall 148 includes seven circumferential rows of brick-like indentations 150 separated by interspersed lands 152. Base 146 is similar to base 106 in FIG. 8C including a ribbed portion with ribs 154 extending outwardly from a button-like central portion 156, but peripheral rigid support portion 158 includes pressure relief formations 160 around the periphery of support portion 158.

Figure 2A:
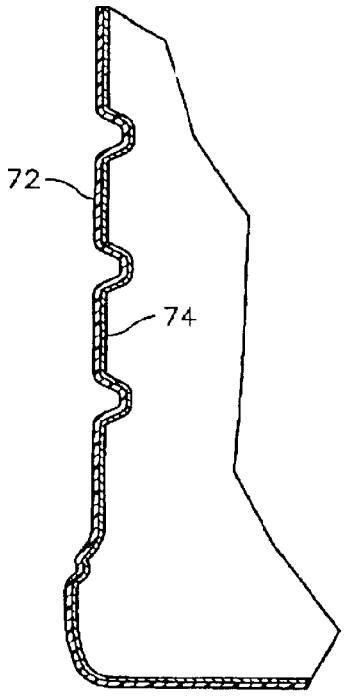
FIG. 2A is a partial sectional view of the sidewall and base of the container of FIG. 2.
Figure 2B:
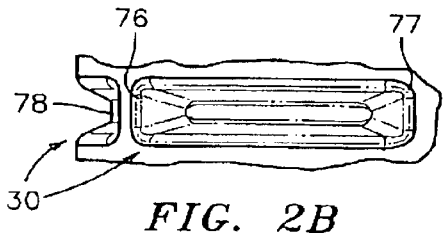
FIG. 2B is an enlarged view of portion 2B of FIG. 2 showing details of the reinforcement formations.

FIG. 2A is a partial sectional view of the sidewall and base of the container of FIG. 2 showing the plastic outer material 72 and interior coating 74, and FIG. 2B is an enlarged view of portion 2B of FIG. 2 showing details of the reinforcement formations 30 including width from one end 76 to the other end 77 and depth 78.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application.

What is claimed is:

1. A plastic container comprising: a self-supporting base; a body portion extending above the base, said body portion including an annular wall; and a neck portion extending above the body portion, said neck portion including a dispensing opening; wherein said body portion includes a substantially rigid sidewall portion including a structural reinforcement, said structural reinforcement including a plurality of reinforcement formations extending around said annular wall in the form of indentations and interspersed lands arranged in a staggered, overlapping configuration, said reinforcement formations being rectangular, brick-like formations with a recessed central portion, wherein said reinforcement formations are separated by intervening raised lands and are present in a plurality of circumferential rows each of which extend completely around said annular wall, and wherein said rectangular, brick-like formations have a width and a depth, and the ratio of width to depth is from 10:1 to 2:1.

2. A container according to claim 1, including 4 to 8 of said rows.

3. A container according to claim 2, wherein the ratio of width to depth is from 2:1 to 3:1.

4. A container according to claim 2, wherein the ratio of width to depth is from 8:1 to 10:1.

5. A container according to claim 1, wherein the base includes a flexible portion configured to contract upwardly in response to vacuum generated within the container.

6. A container according to claim 5, wherein the base includes a substantially rigid, peripheral support portion, a central flexible portion and a transition segment between the support portion and the flexible portion.

7. A container according to claim 1, wherein said sidewall portion includes at least one annular ring.

8. A container according to claim 7, wherein said at least one annular ring is above said brick-like formations.

9. A container according to claim 1, wherein said body portion includes at least one additional pressure relief formation.

10. A container according to claim 1, wherein said plastic container includes recycled plastic material.

11. A container according to claim 1, wherein said container includes a coating on the internal surface of the container.

12. A container according to claim 11, wherein said coating is a carbon coating.

13. A container according to claim 1, wherein said container is hot fillable.

14. A container according to claim 1, wherein said body portion includes a shoulder portion between the sidewall portion and the neck portion, and wherein said shoulder portion includes at least one pressure relief formation that can move inwardly in response to internal pressure.

15. A container according to claim 1, the base includes a plurality of support legs separated by recessed portions.

16. A container according to claim 1, wherein the base includes a ribbed portion with ribs extending outwardly from a button-like central portion and a peripheral outer rigid support portion.

17. A container according to claim 16, wherein the peripheral rigid support portion includes pressure relief formations thereon.

18. A container according to claim 1, wherein the base includes a circumferential ribbed area surrounding a central button-like portion.

* * * * *